US012270274B2

(12) United States Patent
Bock et al.

(10) Patent No.: US 12,270,274 B2
(45) Date of Patent: Apr. 8, 2025

(54) DISPLACEABLE SHOE TRACK ASSEMBLY

(71) Applicant: WEATHERFORD TECHNOLOGY HOLDINGS, LLC, Houston, TX (US)

(72) Inventors: Micheal Bock, Montgomery, TX (US); Travis W. Massey, Houston, TX (US); Zachary S. Trine, Houston, TX (US); Ryan Mogensen, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 18/750,652

(22) Filed: Jun. 21, 2024

(65) Prior Publication Data

US 2024/0344421 A1 Oct. 17, 2024

Related U.S. Application Data

(62) Division of application No. 17/881,037, filed on Aug. 4, 2022, now Pat. No. 12,055,010.

(51) Int. Cl.
*E21B 33/16* (2006.01)

(52) U.S. Cl.
CPC ..... *E21B 33/16* (2013.01)

(58) Field of Classification Search
CPC ..... E21B 33/13; E21B 33/16
See application file for complete search history.

(56) References Cited

U.S. PATENT DOCUMENTS 2,352,744 A * 7/1944 Stoddard ..... E21B 33/14 137/515
3,213,940 A * 10/1965 Wood ..... E21B 33/16 166/291
4,671,358 A * 6/1987 Lindsey, Jr. ..... E21B 34/14 166/291
4,966,236 A * 10/1990 Braddick ..... E21B 43/10 166/291
4,986,361 A * 1/1991 Mueller ..... E21B 23/08 166/381

(Continued)

FOREIGN PATENT DOCUMENTS

CA 692666 A 8/1964
CA 3145373 A1 7/2022

OTHER PUBLICATIONS

Int'l Search Report and Written Opinion in PCT/US2023/023619 mailed Aug. 16, 2023, 10-pgs.
Weatherford. "Casing Wiper Plugs and Darts." 2013. 58 pages.

*Primary Examiner* — David Carroll
(74) *Attorney, Agent, or Firm* — Cabello Hall Zinda, PLLC

(57) ABSTRACT

A cementing operation cements casing in a borehole. A bottom plug pumped down the casing ahead of cement lands at a float valve. Circulation of the cement is established through the bottom plug to a shoe track downhole from the float valve. A top plug pumped down the casing behind the cement lands on the bottom plug. An internal component of the float valve is released by building-up pressure in the casing behind the internal component up to a release threshold. The internal component can latch at the shoe. At least some of the cement in the shoe track is displaced from the casing's shoe to the borehole by pumping the plugs and the internal component to the shoe. With the cement displaced out of the shoe track, the time required to drill out the assembly can be greatly reduced.

20 Claims, 5 Drawing Sheets

(56) References Cited

U.S. PATENT DOCUMENTS

| | | | | |
|---|---|---|---|---|
| 5,117,915 | A | 6/1992 | Mueller et al. | |
| 5,829,523 | A | 11/1998 | North | |
| 6,491,103 | B2 * | 12/2002 | Allamon | E21B 33/165 166/318 |
| 6,622,798 | B1 | 9/2003 | Rogers et al. | |
| 7,798,225 | B2 | 9/2010 | Giroux et al. | |
| 9,080,422 | B2 | 7/2015 | Melenyzer | |
| 9,328,585 | B2 | 5/2016 | Groesbeck et al. | |
| 10,378,304 | B2 | 8/2019 | Budde | |
| 10,487,618 | B2 | 11/2019 | Budde | |
| 10,648,272 | B2 | 5/2020 | Budde et al. | |
| 10,954,740 | B2 | 3/2021 | Budde et al. | |
| 11,047,202 | B2 | 6/2021 | Budde et al. | |
| 11,078,750 | B2 | 8/2021 | Giroux | |
| 2007/0029082 | A1 * | 2/2007 | Giroux | E21B 33/14 166/387 |
| 2011/0162844 | A1 | 7/2011 | Mauth et al. | |
| 2013/0092375 | A1 * | 4/2013 | Melenyzer | E21B 43/261 166/291 |
| 2015/0101801 | A1 * | 4/2015 | Budde | E21B 33/14 166/387 |
| 2016/0326807 | A1 | 11/2016 | Jerez et al. | |
| 2020/0063524 | A1 * | 2/2020 | Giroux | E21B 33/124 |
| 2020/0362686 | A1 | 11/2020 | Puwanto et al. | |
| 2021/0047898 | A1 | 2/2021 | Garcia et al. | |

* cited by examiner

DISPLACEABLE SHOE TRACK ASSEMBLY

CROSS-REFERENCE TO REPLATED APPLICATIONS

This is a divisional of U.S. application Ser. No. 17/881,037 filed Aug. 4, 2022, which is incorporated herein by reference in its entirety.

BACKGROUND OF THE DISCLOSURE

During completion of a wellbore, casing is cemented in a borehole using cement. The bottom hole assembly (BHA) of the casing typically has a shoe track, which includes a float collar, a length of tubing, and a float shoe on the casing's toe. Once a cementing operation is done, the shoe track is drilled out using a drill string run down the casing to drill out the float shoe, the cement plugs, and residual cement in the shoe track.

For example, FIGS. 1A-1D illustrate successive stages of performing a cementing operation using an assembly 10 according to the prior art. The assembly 10 includes a casing string 12 disposed in a borehole 15. The bottom hole assembly of the casing string 12 includes a shoe track T having a float collar 30, a length of tubing 14, and a float shoe 20 on the toe of the casing string 12. During the cementing operation as shown in FIG. 1A, a bottom plug 40 is pumped down the casing string 12 followed by a spacer fluid S and cement slurry C. The bottom plug 40 can include an internal barrier 42, valve, or the like to separate the spacer fluid S from the borehole fluids ahead of the bottom plug 40.

Eventually as shown in FIG. 1B, the bottom plug 40 lands at the float collar 30, which includes a check valve 32. The internal barrier 42 of the bottom plug 40 is then opened so the spacer fluid S and cement slurry C can flow through the passage 44 of the plug 40, through the check valve 32 of the float collar 30, and out of the float shoe 20 to the borehole 15. As shown, the float shoe 28 may also have a check valve 22.

Behind the cement slurry C, a top wiper plug 50 is pumped down the casing string 12 with a displacement fluid D. The wiper plug 50 keeps the displacement fluid D from mixing with the cement slurry C, and the plug 50 wipes the interior of the casing string 12. As shown in FIG. 1C, the wiper plug 50 eventually engages with the bottom plug 40 to close off fluid communication through the plug's passage 44.

In some installations, operators can determine that the toe of the assembly 10 and the shoe track T have been properly cemented by detecting a bump indication when the wiper plug 50 engages the bottom plug 40. For example, a calculated volume of displacement fluid D is pumped behind the wiper plug 50 and the cement C during operation. Assuming the cementing operation is successful, the wiper plug 50 reaches the bottom plug 40 when the calculated volume of the displacement fluid D has been pumped. In response, operators can determine that the cementing job is done and that the shoe track T is full of cement. At this point, operators can achieve a positive casing test (performed on the wet cement).

As can be seen in the standard operating procedure outlined above, the shoe track T having the length of tubing 14 between the float collar 30 and float shoe 20 is filled with cement. This is typically desired as part of the standard procedures so operators can ensure that the cement in the annulus of the borehole 15 toward the toe of the casing string 12 is well cemented. In many installations, the shoe track T can encompass a length L of about 120 ft of tubing 14 filled with cement. The plugs 40, 50 used during the cementing operation are cemented in place.

In the end, operators want the toe to be competently cemented so a wash-out zone can be minimized and so a competent formation integrity test (FIT) can be performed against a newly drilled formation below the cemented casing string 12. For this reason, the standard operating procedure discussed above fills the shoe track T with cement to reduce the chance of having a wet shoe form after cementing. Additionally, filling the shoe track T with cement allows operators to obtain reliable results from a casing integrity test after the cementation is done.

Finally, as shown in FIG. 1D, the bottom hole assembly is drilled out to remove the check valves 32, 22 of the collars 30 and the shoe 20, to remove the plugs 40, 50, and to remove the residual cement in the tubing 14 of the shoe track T. Any wash-up must also be drilled out and can be about ±60 ft. As a result, the conventional shoe track T that needs to be drilled out can extend 45 to 130 ft. This drill out of the cement-filled shoe track T can take between 7 to 10 hours of rig time to complete. After drill out, operators can then perform the formation integrity test (FIT) before drilling the next interval of the borehole beyond the cemented casing string 12.

As will be appreciated, rig time presents one of the highest costs for a drilling operation so reducing rig time brings significant value to the operators. The conventional shoe track T full of cement currently produced in the standard procedures requires an extending period of rig time and can lead to excess bit wear inside the casing string 12. What is needed is a way to reduce the rig time required once a cementing operation is completed.

The subject matter of the present disclosure is directed to overcoming, or at least reducing the effects of, one or more of the problems set forth above.

SUMMARY OF THE DISCLOSURE

A method disclosed herein is used for cementing casing in a borehole with cement. The method comprises: pumping at least one plug down the casing behind the cement, the casing having a shoe track between a float valve and a shoe of the casing; landing the at least one plug at the float valve; releasing an internal component of the float valve by building-up pressure in the casing behind the internal component up to a release threshold; and displacing at least some of the cement in the shoe track out of the shoe to the borehole by pumping the at least one plug and the internal component toward the shoe.

An assembly disclosed herein is used for cementing casing in a borehole with cement. The assembly comprises a float collar, a shoe, at least one plug, and a temporary retainer. The float collar is configured to install on the casing, and the shoe is configured to install downhole of the float collar on a shoe track of the casing. The float collar has an internal component with a one-way valve, which is configured to permit downhole fluid communication and to prevent uphole fluid communication. The at least one plug is configured to land at the float collar and is configured to close the downhole fluid communication through the one-way valve. Meanwhile, the temporary retainer is configured to temporarily retain the internal component in the float collar. In response to a release threshold, the temporary retainer is configured to release the internal component from the float collar. The internal component is configured to displace at least a portion of the cement from the shoe track out of the shoe.

The foregoing summary is not intended to summarize each potential embodiment or every aspect of the present disclosure.

DETAILED DESCRIPTION OF THE DISCLOSURE

Figures 1A, 1B, 1C, 1D:
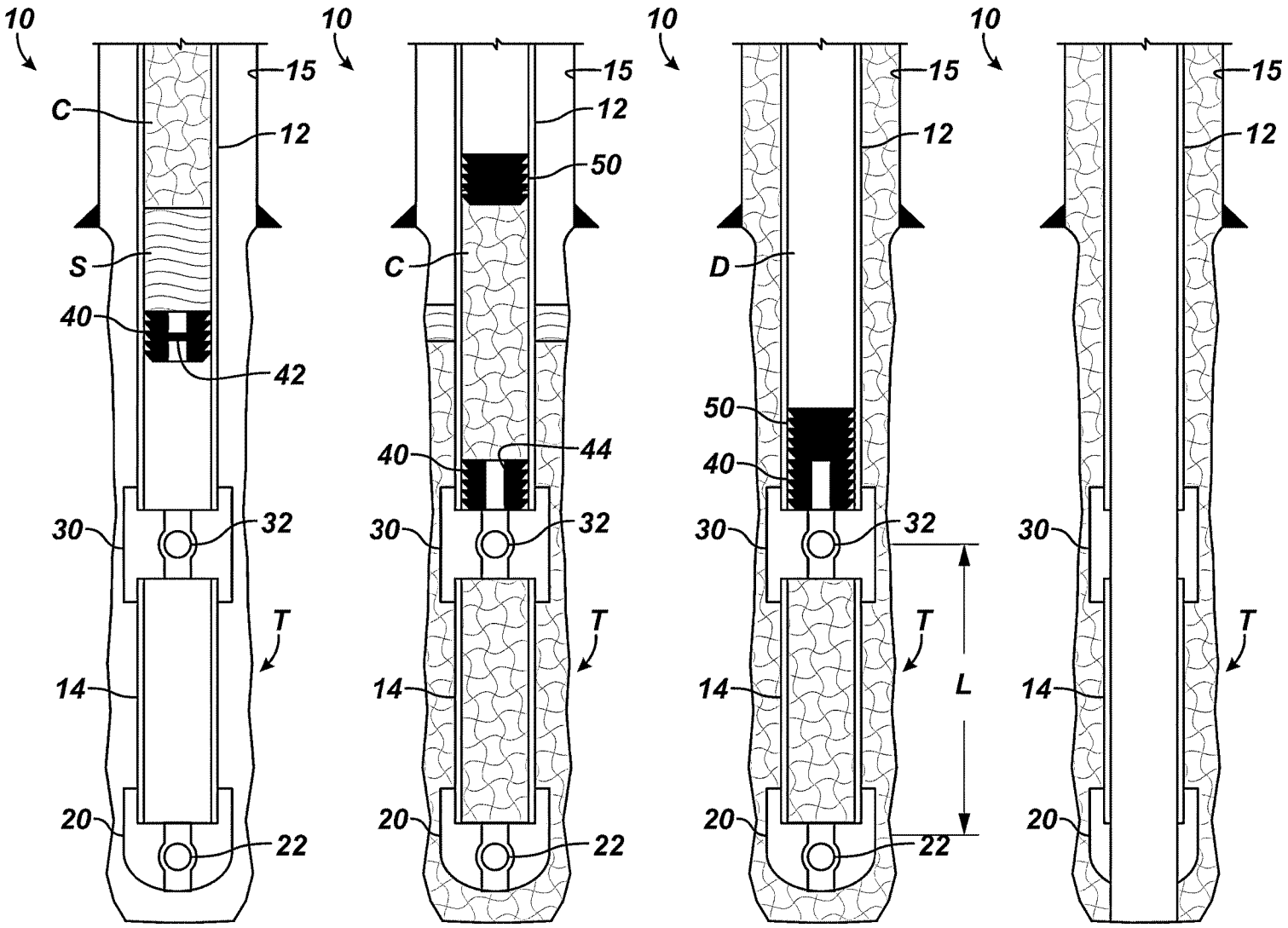
FIG. 1A (Prior Art)
FIG. 1B (Prior Art)
FIG. 1C (Prior Art)
FIG. 1D (Prior Art)
FIGS. 1A-1D illustrate successive stages of performing a cementing operation using an assembly according to the prior art.

FIGS. 2A-2E illustrate successive stages of performing a cementing operation using an assembly 100 according to the present disclosure. The assembly 100 includes a casing string 12 disposed in a borehole 15. The bottom hole assembly on the casing string 12 includes a shoe track T having a float collar 110, a length of tubing 14, and a float shoe 20 on the toe of the casing string 12. In many installations, the shoe track T can encompass a length L of about 120 ft of the tubing 14. Although the float shoe 20 is shown herein having a check valve 22, other arrangements can instead use a casing shoe 20 lacking a valve.

In many installations, multiple plugs are used during the cementing operations, including a bottom plug 40 used ahead of cement slurry pumped down the casing string 12, and a top plug 50 used behind the cement slurry. This type of installation using two plugs 40, 50 is described here. Different installations can more generally use one or more plugs. Accordingly, the teachings of the present disclosure can be applied to installations that use at least one plug for the cementing operation.

Figure 2A:
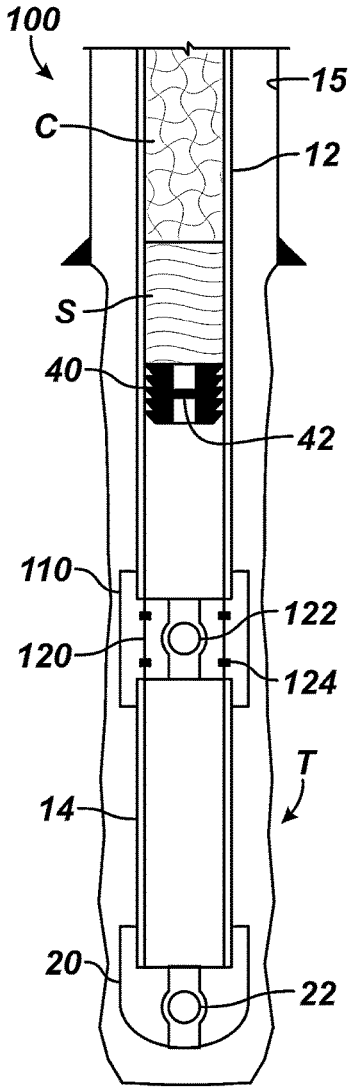
FIGS. 2A-2E illustrate successive stages of performing a cementing operation using an assembly according to the present disclosure.

During the cementing operation as shown in FIG. 2A, the bottom plug 40 is pumped down the casing string 12 followed by a spacer fluid S and cement slurry C. The bottom plug 40 can include a breachable barrier 42, bust disk, valve, or the like to separate the spacer fluid S from the borehole fluids ahead of the plug 40.

Figure 2B:
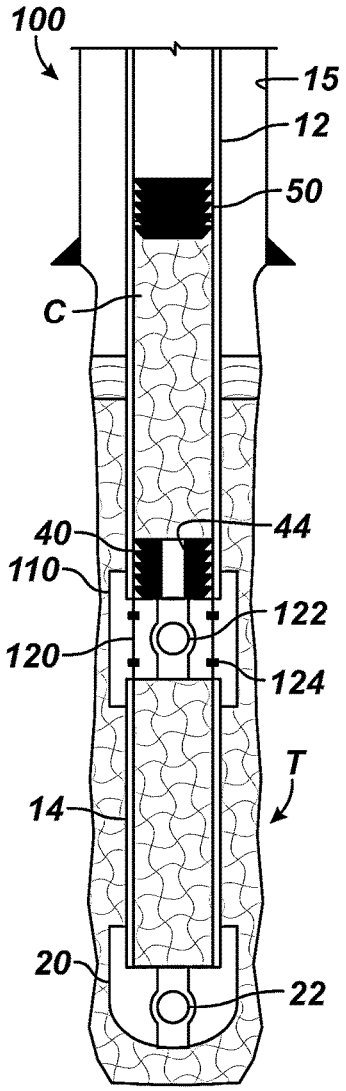

Eventually as shown in FIG. 2B, the bottom plug 40 lands at the float collar 110, which includes a check valve 122. (As will be appreciated, the check valve 122 is typically a one-way valve configured to permit downhole fluid communication through the valve 122 and to prevent uphole fluid communication through valve 122. More than one check valve 122 can be used in the float collar 110.) The internal barrier 42 of the bottom plug 40 is then opened using pressure behind the barrier 42 so the spacer fluid S and the cement slurry C can flow through the passage 44 of the plug 40, through the check valve 122 of the float collar 110, and out of the float shoe 20 to the borehole 15.

Figure 2C:
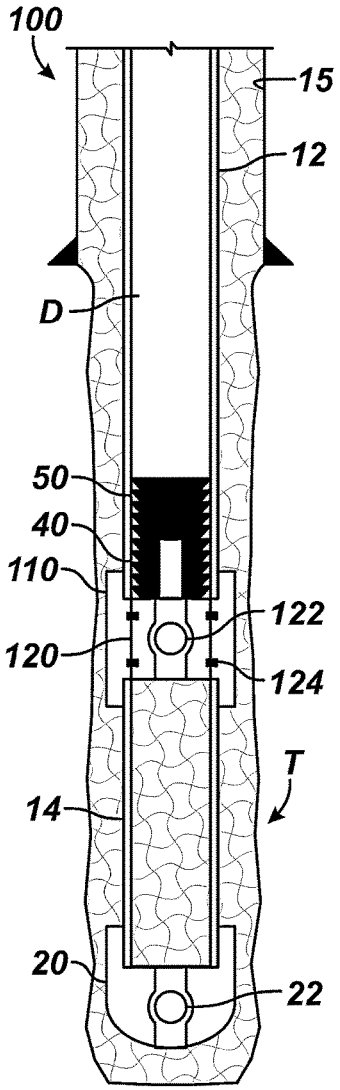

The top wiper plug 50 is pumped behind the cement slurry C with a displacement fluid D. The wiper plug 50 keeps the displacement fluid D from mixing with the cement slurry C and wipes the interior of the casing string 12. As shown in FIG. 2C, the wiper plug 50 eventually engages with the bottom plug 40 to close off fluid communication through the plug's passage 44.

When the wiper plug 50 bumps on the float collar 110, a bump indication assures the operator that the shoe track T and the toe of the casing string 12 have been cemented. For example, during proper operations, the wiper plug 50 is pumped to the float collar 110 using a calculated volume of displacement fluid D. When the wiper plug 50 has been pumped with an acceptable value of this calculated volume, a pressure response is detected at surface, which can indicate to the operators that the wiper plug 50 has bumped/located on the bottom plug 40. This in turn indicates that the shoe track T is full of cement. At this point, operators can then achieve a positive casing test performed on the wet cement.

Should operators not see a bump indication from the wiper plug 50 engaging the float collar 110, the operators can pump a calculated displacement volume equal to half of the shoe track T in capacity. If a bump indication still does not occur, then there is likely no pressure containment point to perform a pressure test of the casing against. Remedial actions would be necessary because some form of a leak is present.

In the present assembly 100, the float collar 110 includes an internal component 120 having the check valve 122 and other features. The internal component 120 can be released from the float collar 110 by releasing a temporary support or retainer 124 between the internal component 120 and the external housing of the float collar 110. Releasing the temporary retainer 124 can involve shifting collets; releasing dogs; breaking detent rings; shearing screws, pins, or other elements; or shearing a shouldered material.

Figure 2D:
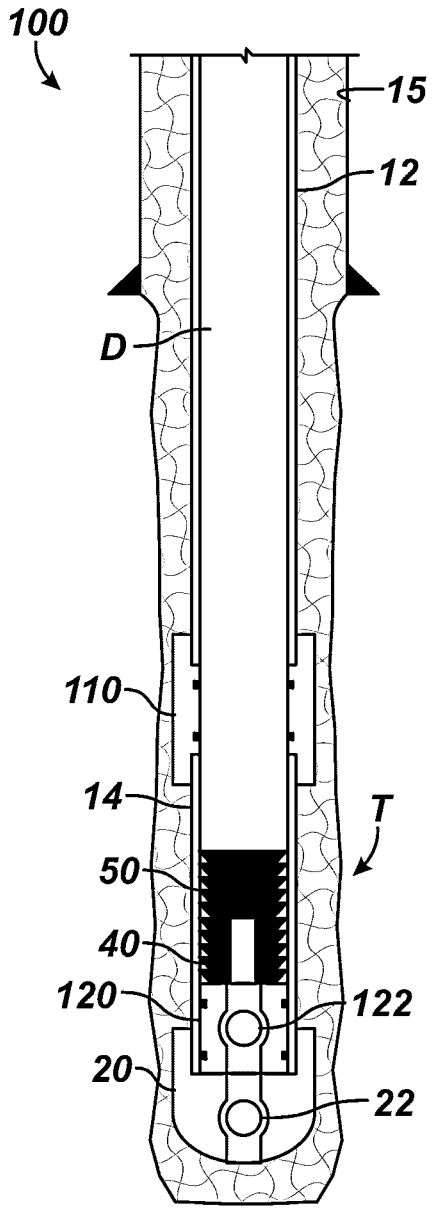

Continuing with the operations as shown in FIGS. 2C-2D, operators build up the pressure of the displacement fluid D to a release threshold (e.g., shear value) for the temporary retainer 124 of the float collar 110. Eventually, the internal component 120 of the float collar 110 is released from (e.g., is shears out of) the collar's housing. The plugs 40, 50 and the internal component 120 are then displaced down the casing string 12 to a locator profile 25 machined into the shell of the float shoe 20. This displaces the volume of wet cement in the shoe track T so the cement is squeezed out of the float shoe 20 and into the toe of the borehole 15.

A second bump/location indication can then be obtained at surface when the float collar's internal component 120 engages the float shoe 20. Ultimately, the internal component 120 can latch in the locator profile 25 in the float shoe 20 to provide a secondary barrier. For example, the internal component 120 can include a latch ring, a locator dog, or other locking feature that engages in a profile, slot, or the like in the float shoe 20. In response to the second bump indication, operators can determine that the cementing job is done. As a result of the procedures performed with this assembly 100, a considerably shorter shoe track T of about 2 to 4 ft. is left to be drilled out, instead of the conventional shoe track of 45 to 130 ft that needs to be drilled out when standard procedures are used.

Figure 2E:
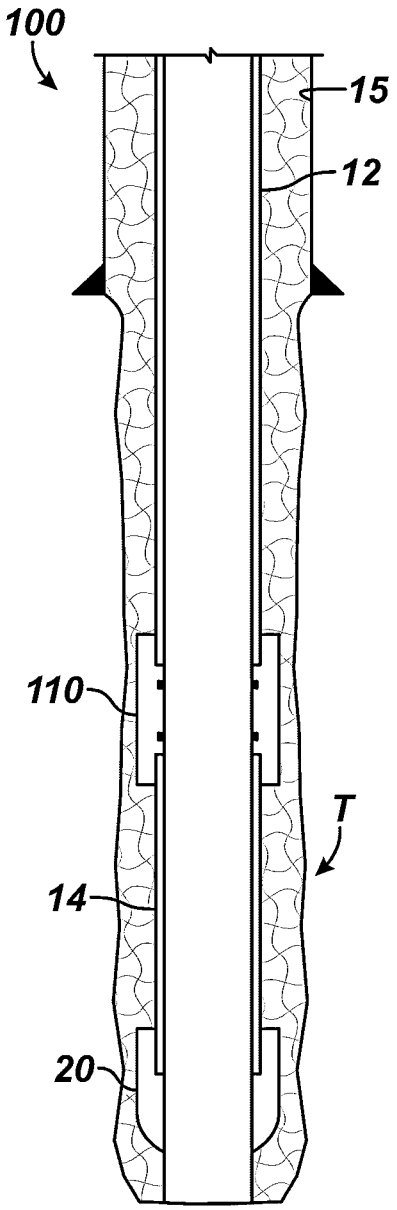

Once landed, the float collar's internal component 120 and the plugs 40, 50 can once again hold back pressure. Once the cement sets, operators can then achieve another positive casing test on the competent cement by using a drilling BHA in the hole. Finally, as shown in FIG. 2E, the bottom hole assembly is drilled out to remove the 8 to 10 ft length having the plugs 40, 50, the float collar's internal component 120, and the float shoe 20 from the shoe track T. Any wash up is also drilled out. This drill-out operation may take only about 1 to 3 hours of rig time to complete. A formation integrity test (FIT) can finally be performed before drilling the next interval.

As noted in the background, the standard procedure leaves the conventional shoe track full of cement to reduce the chances of having a wet shoe. In contrast, the assembly 100 of the present disclosure reduces the length of the shoe track T that needs to be drilled out while giving operators bump/location indications to assess proper cementing of the toe of the casing string 12. The assembly 100 still includes both the float collar 110 and the float shoe 20, but the assembly 100 transitions the shoe track T from the conventional length of about 130 ft. down to about 3 to 5 ft.

FIGS. 3A-3D illustrate one particular arrangement of the assembly 100 in some more detail. Similar components to those discussed above have the same reference numerals so similar details may not be repeated here. Operation of the assembly 100 is also similar and may not be fully described again with reference to FIGS. 3A-3D.

In this arrangement, the top and bottom plugs 40, 50 are part of a sub-surface release system (not shown) having a landing string disposed further uphole in the casing string 12. Top and bottom darts 46, 56 are used to activate and launch the respective top and bottom plugs 40, 50 from the release system. To do this, the darts 46, 56 separate fluids in the landing string of the release system (not shown) and activate a releasing mechanism in the respective plugs 40, 50 to launch them in the casing string 12.

Figure 3A:
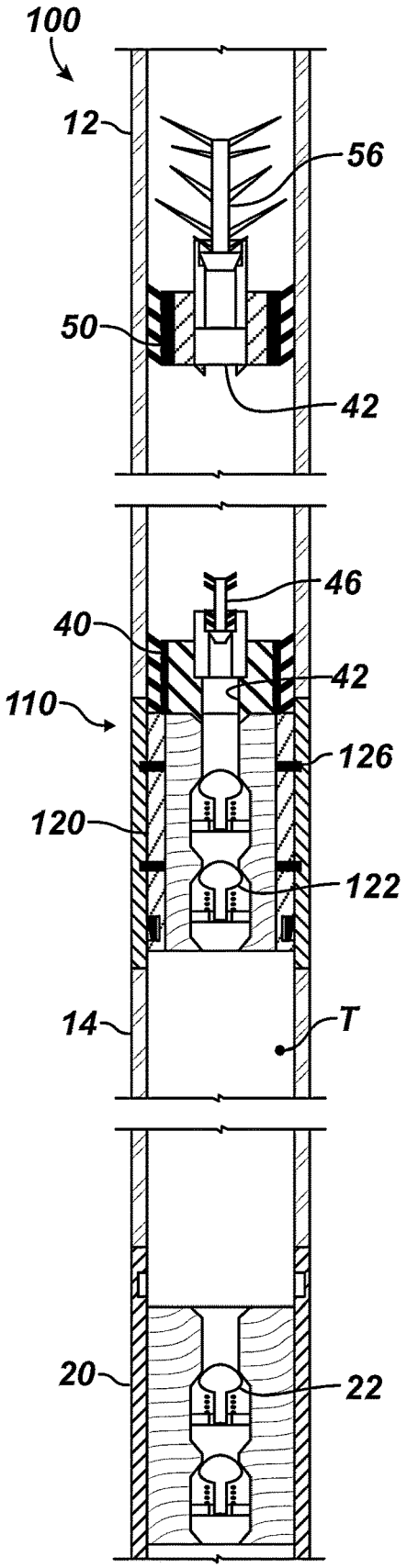
FIGS. 3A-3D illustrate successive stages of performing a cementing operation using one arrangement of the disclosed assembly.

Initially, the bottom dart 46 is pumped from the surface through the system's landing string in front of the cement slurry. The dart 46 latches into the bottom plug 40 in the sub-surface release system (not shown), and the bottom plug 40 is released to pass through the casing string 12 to land on the float collar 110, as shown in FIG. 3A. The bottom plug 40 includes a breachable barrier, such as a rupture disk 42. After the plug 40 lands on the float collar 110, the rupture disk 42 is opened so circulation can be re-established in the casing string 12 to pump the cement slurry into the annulus between the borehole 15 and casing string 12.

Figure 3B:
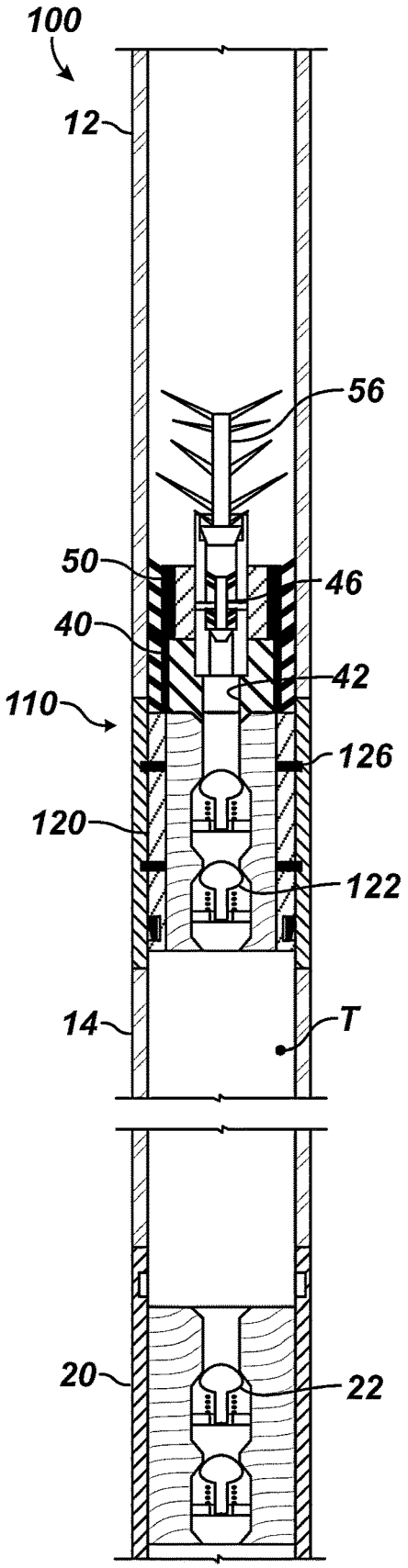

Eventually, the top dart 56 is pumped through the system's landing string behind the cement slurry. The dart 56 latches into the top plug 50 in the sub-surface release system (not shown) to release the top plug 50. After release, the top plug 50 wipes the casing string 12 before landing/bumping on top of the bottom plug 40, as shown in FIG. 3B. As noted, this can provide a positive indication of the cement's displacement, and operators can then achieve a positive casing test performed on the wet cement.

Figure 3C:
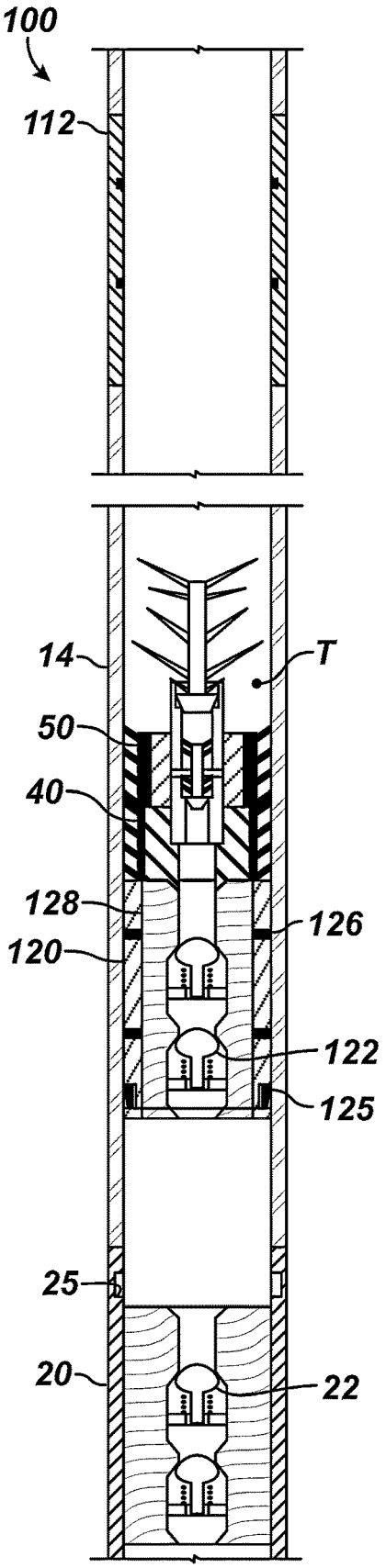

As best shown in FIGS. 3B-3C, the float collar 110 includes an internal component 120 disposed in a housing 112 coupled to the casing string 12. In the present configuration, the internal component 120 includes a shell 126 having a filler 128 that supports a check valve 122 therein. The shell 126 can be composed of a metal or other support material suitable for drilling out, and the filler 128 can be composed of cement or other drillable material. The shell 126 is supported in the housing 112 using the temporary retainer 124, which includes shearable elements as shown here, engaged between the shell 126 and the external housing 112 of the float collar 110. The shell 126 can also be sealed in the housing 112 as appropriate.

In other configurations, the internal component 120 may not have a separate shell 126 and filler 128 of different materials. Instead, the internal component 120 can be composed of a suitable material that can support the check valve 122, can be displaced from the housing of the float collar 110, and can be drilled out at the end of operations.

Figure 3D:
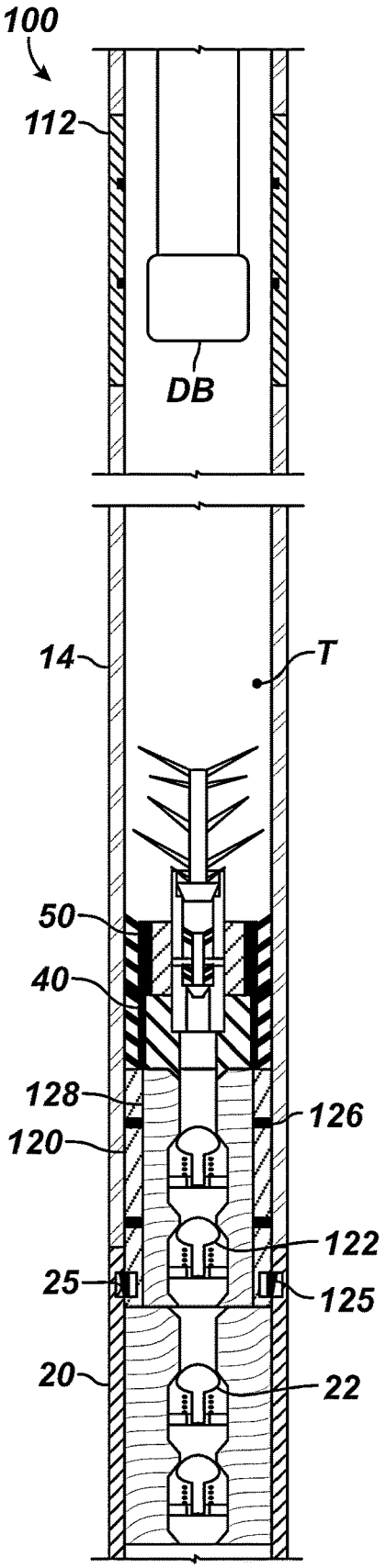

Continuing with the operations as shown in FIGS. 3C-3D, operators build up pressure behind the seated plugs 40, 50 in the float collar 110 to a release threshold (e.g., shear value) for the shearable elements 124 to release the internal component 120 from the housing 112 of the float collar 110. With the elements 124 sheared, the plugs 40, 50 and the internal component 120 are displaced down the casing string 12 to the float shoe 20. This displaces the volume of cement in the shoe track T so the cement can be squeezed out the float shoe 20 and into the toe of the borehole 15.

A second bump/location indication can then be obtained at surface when the internal component 120 and plugs 40, 50 engage the float shoe 20. Ultimately, a latch 125, such as a latch ring, a locator dog, or other locking feature, on the shell 126 can latch in a locator profile 25 or the like in the housing of the float shoe 20.

Once the cement sets, the shell 126, the filler 128, the check valve 122, and the plugs 40, 50 can once again hold back pressure so operators can achieve a positive casing test on competent cement by using a drilling BHA DB in the casing string 12. The entire bottom hole assembly can then be drilled out to remove the plugs 40, 50, the shell 126, the filler 128, the check valve 122, and the float shoe's valve 22 from the shoe track T.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An assembly for cementing casing in a borehole with cement, the assembly comprising:

a float collar being configured to install on the casing, the float collar having an internal component with a one-way valve, the one-way valve being configured to permit downhole fluid communication through the float collar and being configured to prevent uphole fluid communication through the float collar;

a shoe track being configured to install downhole of the float collar;

a bottom plug being configured to land at the internal component of the float collar ahead of at least a portion of the cement, the bottom plug having a passage to establish fluid circulation through the bottom plug for passing through the internal component, into the shoe track downhole from the float collar, and out of the shoe track into the borehole;

a top plug being configured to land on the bottom plug at the internal component behind at least the portion of the cement and being configured to close the fluid circulation through the passage of the bottom plug; and a temporary retainer being configured to temporarily retain the internal component in the float collar, the temporary retainer being configured to release the internal component, the bottom plug, and the top plug as a unit from the float collar in response to a release threshold, the internal component, the bottom plug, and the top plug as the unit being configured to displace at least a portion of the cement in the shoe track into the borehole.

2. The assembly of claim 1, wherein the shoe track comprises another one-way valve being configured to permit the downhole fluid communication from the shoe track into borehole and being configured to prevent the uphole fluid communication from the borehole into the shoe track.

3. The assembly of claim 1, wherein the shoe track comprises a locator; and wherein the internal component comprises a latch configured to latch in the locator.

4. The assembly of claim 1, wherein the float collar comprises a housing configured to install on the casing; and wherein the internal component comprises a shell having a filler disposed therein, the filler supporting the one-way valve.

5. The assembly of claim 4, wherein the temporary retainer comprises at least one shearable element engaged between the shell and the housing, the at least one shearable element being configured to shear in response to the release threshold.

6. The assembly of claim 1, wherein the temporary retainer comprises at least one of a shiftable collet, a releasable dog, a breakable detent ring, a shearable element, a shear pin, a shear screw, and a shearable shoulder.

7. The assembly of claim 1, wherein the bottom plug comprises a breachable barrier in the passage, the breachable barrier being breachable to open the fluid circulation through the passage of the bottom plug.

8. The assembly of claim 7, wherein the breachable barrier comprises at least one of a rupture disk, a bust disk, and a valve.

9. The assembly of claim 1, wherein at least one of:

the bottom plug and the internal component are configured to produce a first pressure bump at surface indicative of the bottom plug landed at the internal component;

the top plug, the bottom plug, and the internal component are configured to produce a second pressure bump at surface indicative of the top plug landed on the bottom plug at the internal component; and the unit of the top plug, the bottom plug, and the internal component is configured to produce a third pressure bump at surface indicative of the unit landing at the shoe track.

10. The assembly of claim 1, wherein at least one of:

the top plug, the bottom plug, and the internal component are configured to hold a first positive casing test pressure pumped in the casing against the top plug landed on the bottom plug at the internal component in the float collar; and the unit of the top plug, the bottom plug, and the internal component is configured to hold a second positive casing test pressure pumped in the casing against the unit landed at the shoe track.

11. An assembly for cementing casing in a borehole with cement, the assembly comprising:

a float collar having a housing and an internal component, the housing being configured to install on the casing, the internal component disposed in the housing and having one-way valve, the one-way valve being configured to permit downhole fluid communication through the float collar and being configured to prevent uphole fluid communication through the float collar;

a shoe track being configured to install downhole of the float collar;

a bottom plug being configured to land at the internal component of the float collar ahead of at least a portion of the cement, the bottom plug having a passage with a breachable barrier, the breachable barrier being breachable to establish fluid circulation of the cement through the bottom plug for passing through the internal component, into the shoe track downhole from the float collar, and out of the shoe track into the borehole;

a top plug being configured to land on the bottom plug at the internal component behind at least the portion of the cement and being configured to close the fluid circulation through the passage of the bottom plug; and a temporary retainer being configured to temporarily retain the internal component in the housing of the float collar, the temporary retainer being configured to release the internal component, the bottom plug, and the top plug as a unit from the housing of the float collar in response to a release threshold, the unit of the internal component, the bottom plug, and the top plug being configured to displace at least a portion of the cement in the shoe track into the borehole.

12. The assembly of claim 11, wherein the shoe track comprises another one-way valve being configured to permit the downhole fluid communication from the shoe track into borehole and being configured to prevent the uphole fluid communication from the borehole into the shoe track.

13. The assembly of claim 11, wherein the shoe track comprises a locator; and wherein the internal component comprises a latch configured to latch in the locator.

14. The assembly of claim 11, wherein the temporary retainer comprises at least one shearable element engaged between the internal component and the housing, the at least one shearable element being configured to shear in response to the release threshold.

15. The assembly of claim 11, wherein the temporary retainer comprises at least one of a shiftable collet, a releasable dog, a breakable detent ring, a shearable element, a shear pin, a shear screw, and a shearable shoulder.

16. The assembly of claim 11, wherein the breachable barrier comprises at least one of a rupture disk, a bust disk, and a valve disposed in the passage.

17. The assembly of claim 11, wherein:

the bottom plug and the internal component are configured to produce a first pressure bump at surface indicative of the bottom plug landed at the internal component;

the top plug, the bottom plug, and the internal component are configured to produce a second pressure bump at surface indicative of the top plug landed on the bottom plug at the internal component; and the unit of the top plug, the bottom plug, and the internal component is configured to produce a third pressure bump at surface indicative of the unit landing at the shoe track.

18. The assembly of claim 11, wherein:

the top plug, the bottom plug, and the internal component are configured to hold a first positive casing test pressure pumped in the casing against the top plug landed on the bottom plug at the internal component in the float collar; and the top plug, the bottom plug, and the internal component are configured to hold a second positive casing test pressure pumped in the casing against the unit landed at the shoe track.

19. The assembly of claim 11, comprising a bottom dart being configured to latch to the bottom plug, the bottom plug having the bottom dart being launchable down the casing and being configured to land at the internal component of the float collar.

20. The assembly of claim 19, comprising a top dart being configured to latch to the top plug, the top plug having the top dart being launchable down the casing and being configured to land on the bottom plug and the top dart at the internal component.

* * * * *